US011034162B2

(12) United States Patent
Kawai

(10) Patent No.: US 11,034,162 B2
(45) Date of Patent: Jun. 15, 2021

(54) PRINTING APPARATUS

(71) Applicant: BROTHER KOGYO KABUSHIKI KAISHA, Nagoya (JP)

(72) Inventor: Junya Kawai, Gifu-ken (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 108 days.

(21) Appl. No.: 16/233,250

(22) Filed: Dec. 27, 2018

(65) Prior Publication Data

US 2019/0299655 A1 Oct. 3, 2019

(30) Foreign Application Priority Data

Mar. 30, 2018 (JP) ..... JP2018-068958

(51) Int. Cl.

| | |
|---|---|
| ***B41J 3/407*** | (2006.01) |
| ***B41J 11/66*** | (2006.01) |
| ***B41J 29/38*** | (2006.01) |
| ***B41J 15/04*** | (2006.01) |
| ***B26D 1/00*** | (2006.01) |

(52) U.S. Cl.

CPC ..... *B41J 3/4075* (2013.01); *B26D 1/0006* (2013.01); *B41J 11/66* (2013.01); *B41J 15/04* (2013.01); *B41J 29/38* (2013.01); *B65H 2404/10* (2013.01)

(58) Field of Classification Search

CPC . B41J 3/4075; B41J 11/66; B41J 15/04; B41J 29/38; B26D 1/0006; B65H 2404/10

See application file for complete search history.

(56) References Cited

U.S. PATENT DOCUMENTS

2014/0072358 A1* 3/2014 Tomomatsu ..... B41J 3/4075 400/583
2015/0246567 A1* 9/2015 Kawai ..... B41J 2/325 347/218

(Continued)

FOREIGN PATENT DOCUMENTS

EP 1040928 A1 10/2000
JP H02068686 A 3/1990

(Continued)

OTHER PUBLICATIONS

Notice of Reasons for Refusal dated Dec. 22, 2020 received from the Japanese Patent Office in related application 2018-068958 together with English language translation.

*Primary Examiner* — David H Banh
(74) *Attorney, Agent, or Firm* — Scully, Scott, Murphy & Presser, PC

(57) ABSTRACT

A printing apparatus configured to print a label image on a medium, the medium on which the label image is printed including: a first end which is an upstream end of a tail region in a conveyance direction that is one of first printing regions in which one first character is lastly printed; and a second end which is an upstream end of a tail character in the conveyance direction that is the most upstream one of second characters printed in a second printing region, and wherein a controller is configured to cause a cutter to cut the medium at a first cutting target position located upstream of the first end when the first end is located more upstream than the second end and at a second cutting target position located upstream of the second end when the second end is located more upstream than the first end.

11 Claims, 12 Drawing Sheets

(56) References Cited

U.S. PATENT DOCUMENTS

| | | | | |
|---|---|---|---|---|
| 2016/0214400 | A1* | 7/2016 | Kawai | B41J 3/4075 |
| 2017/0372177 | A1* | 12/2017 | Ishida | G06F 3/1256 |

FOREIGN PATENT DOCUMENTS

| | | | |
|---|---|---|---|
| JP | H06199016 | A | 7/1994 |
| JP | H07096694 | A | 4/1995 |
| JP | H09240066 | A | 9/1997 |
| JP | 2000225745 | A | 8/2000 |
| JP | 2000280551 | A | 10/2000 |
| JP | 2008155388 | A | 7/2008 |
| JP | 2014213605 | A | 11/2014 |
| JP | 2017209997 | A | 11/2017 |

* cited by examiner

PRINTING APPARATUS

CROSS REFERENCE TO RELATED APPLICATION

The present application claims priority from Japanese Patent Application No. 2018-068958, which was filed on Mar. 30, 2018, the disclosure of which is herein incorporated by reference in its entirety.

BACKGROUND

Technical Field

The following disclosure relates to a printing apparatus.

Description of Related Art

There is known a printing apparatus configured to print characters such as letters and symbols on a medium in which a format indicating printing regions are printed in advance. The printing apparatus prints the characters in the printing regions of the medium. When such a known printing apparatus performs printing on a printed sheet on which printing has been already performed, the printing apparatus determines, by referring to a printing mode in a print-item data file, whether the current printing is to be performed with respect to non-printed regions in which the characters are not yet printed. In the case where the current printing is to be performed with respect to the non-printed regions, those non-printed regions are identified and the current printing is then performed based on print data.

SUMMARY

In some cases, the known printing apparatus performs printing by using the medium in which the format indicating the printing regions are printed in advance, such that the characters are printed in only a part of the printing regions. When printing is thus performed, the printing regions other than those in which the characters are printed remain unprinted or unused, undesirably producing a large amount of blank space in the medium. Further, in the case where the printing apparatus prints characters on a blank portion of the medium different from the printing regions indicated by the format, the size of the blank portion that can be used for printing the characters is limited if the medium has a predetermined constant size.

Accordingly, an aspect of the present disclosure is directed to a printing apparatus configured to create a label, using a medium in which a format indicating specific printing regions are printed in advance, such that characters are appropriately printed in both the specific printing regions and other printing region different from the specific printing regions.

In one aspect of the disclosure, a printing apparatus includes: a conveyor configured to convey, in a predetermined conveyance direction, a medium including a printing surface; a print head configured to perform printing, at a first position, on the medium conveyed by the conveyor; a cutter configured to cut the medium at a second position located downstream of the first position in the conveyance direction; and a controller configured to control a printing operation based on print data of a label image including at least one first character and second characters, wherein the printing surface includes a plurality of first printing regions arranged parallel to the conveyance direction and a second printing region different from the plurality of first printing regions, wherein the controller is configured to: perform, as the printing operation, causing the print head to print of one of the at least one first character in each of at least one of the plurality of first printing regions and to print the second characters in the second printing region while causing the conveyor to convey the medium, so as to print the label image on the medium and causing the cutter to cut the medium on which the label image is printed, so as to create a label, wherein the medium on which the label image is printed includes: a first end which is an upstream end of a tail printing region in the conveyance direction, the tail printing region being one of the plurality of first printing regions in which one of the at least one first character is lastly printed; and a second end which is an upstream end of a tail character in the conveyance direction, the tail character being the most upstream one of the second characters in the conveyance direction printed in the second printing region, and wherein the controller is configured to: cause the cutter to cut the medium at a first cutting target position located upstream of the first end in the conveyance direction in the case where the first end is located more upstream than the second end in the conveyance direction; and cause the cutter to cut the medium at a second cutting target position located upstream of the second end in the conveyance direction in the case where the second end is located more upstream than the first end in the conveyance direction.

BRIEF DESCRIPTION OF THE DRAWINGS

The objects, features, advantages, and technical and industrial significance of the present disclosure will be better understood by reading the following detailed description of one embodiment, when considered in connection with the accompanying drawings, in which.

DETAILED DESCRIPTION OF THE EMBODIMENT

Figure 1:
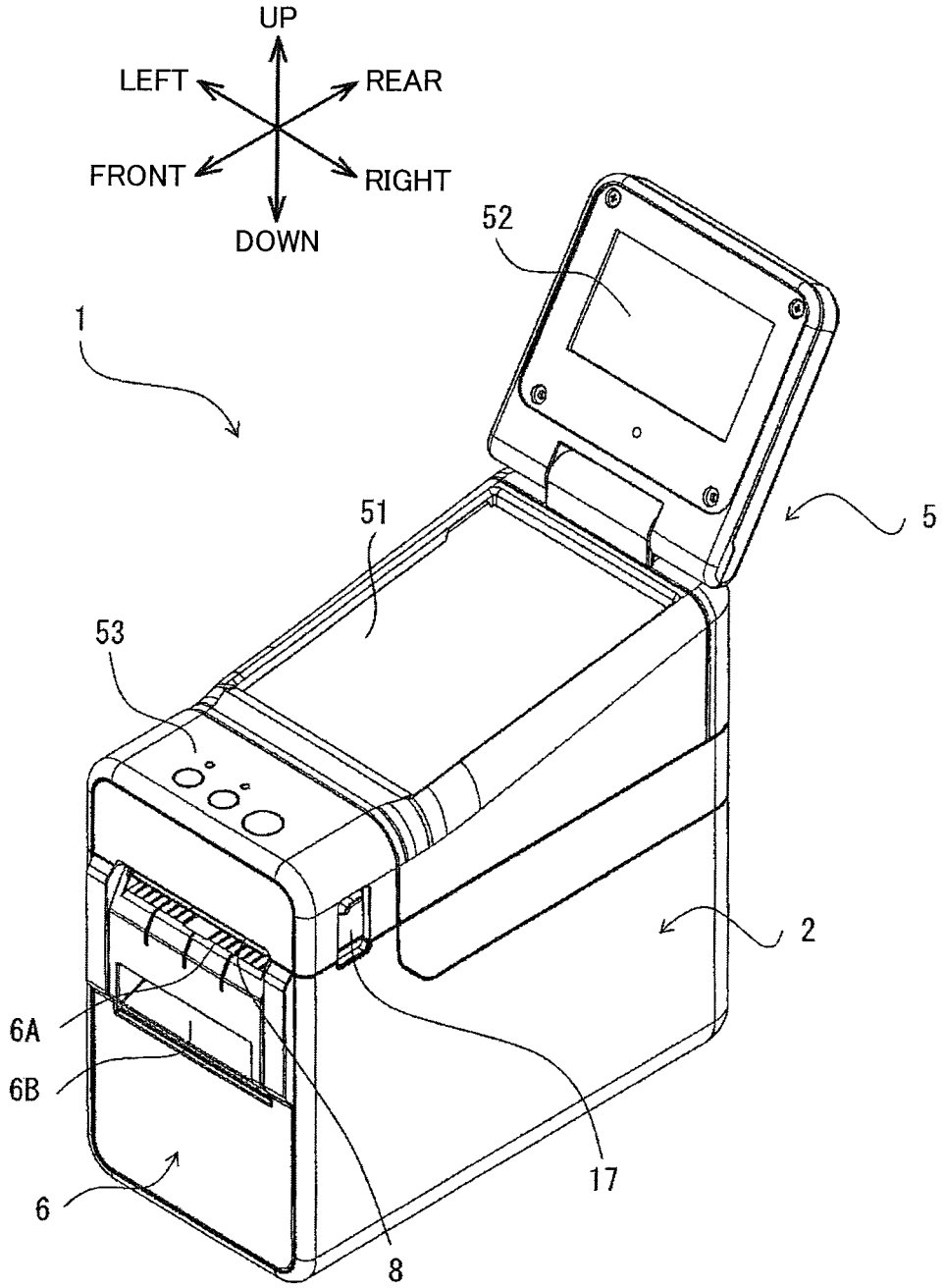
FIG. 1 is a perspective view of a printing apparatus in a state in which a top cover unit is closed.

There will be hereinafter described one embodiment by reference to the drawings. The drawings that are referred to are for explaining technical features employable in the present disclosure. It is to be understood that the configuration illustrated in the drawings does not limit the present disclosure but is only one example.

Figure 2:
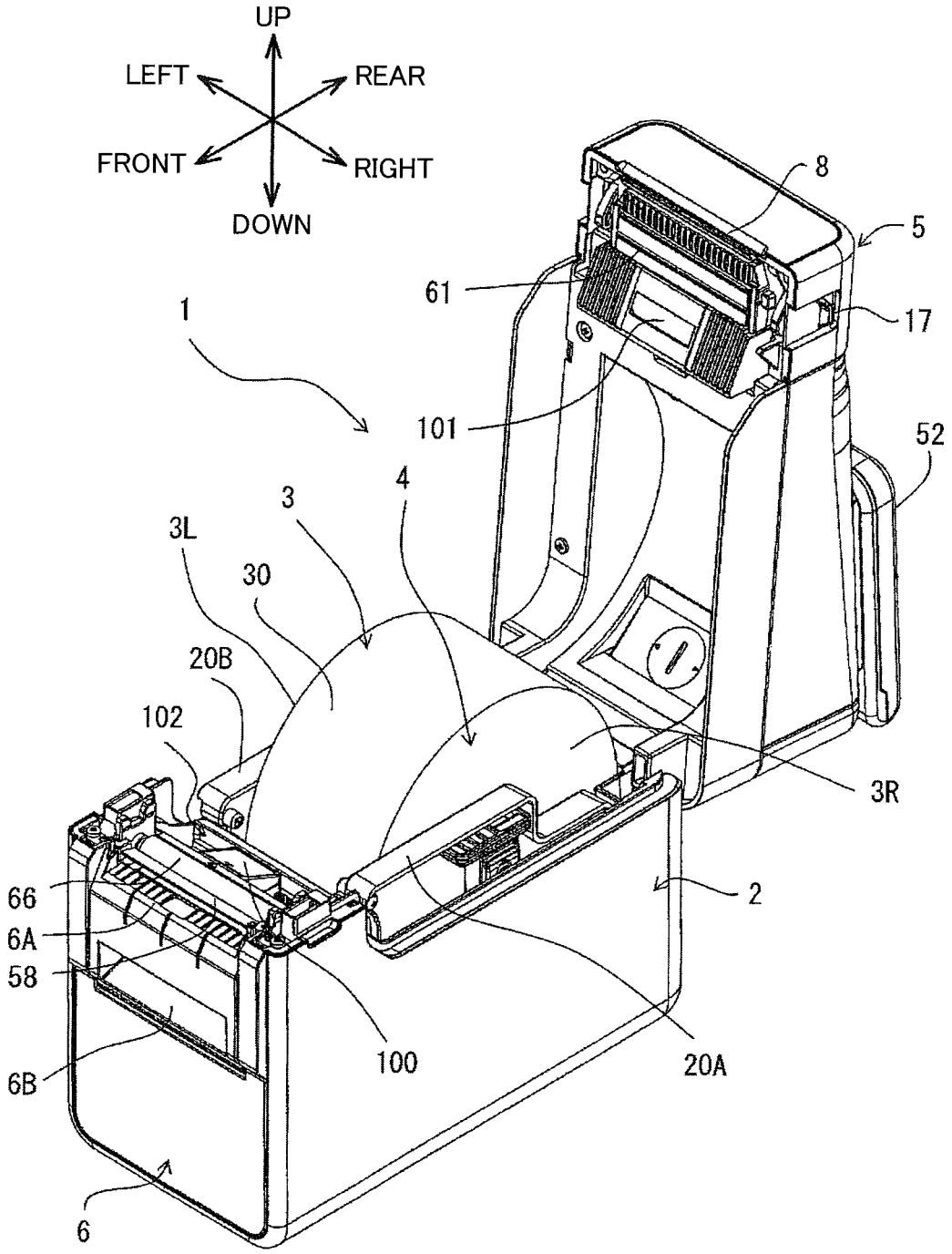
FIG. 2 is a perspective view of the printing apparatus in a state in which the top cover unit is open.
Figure 3:
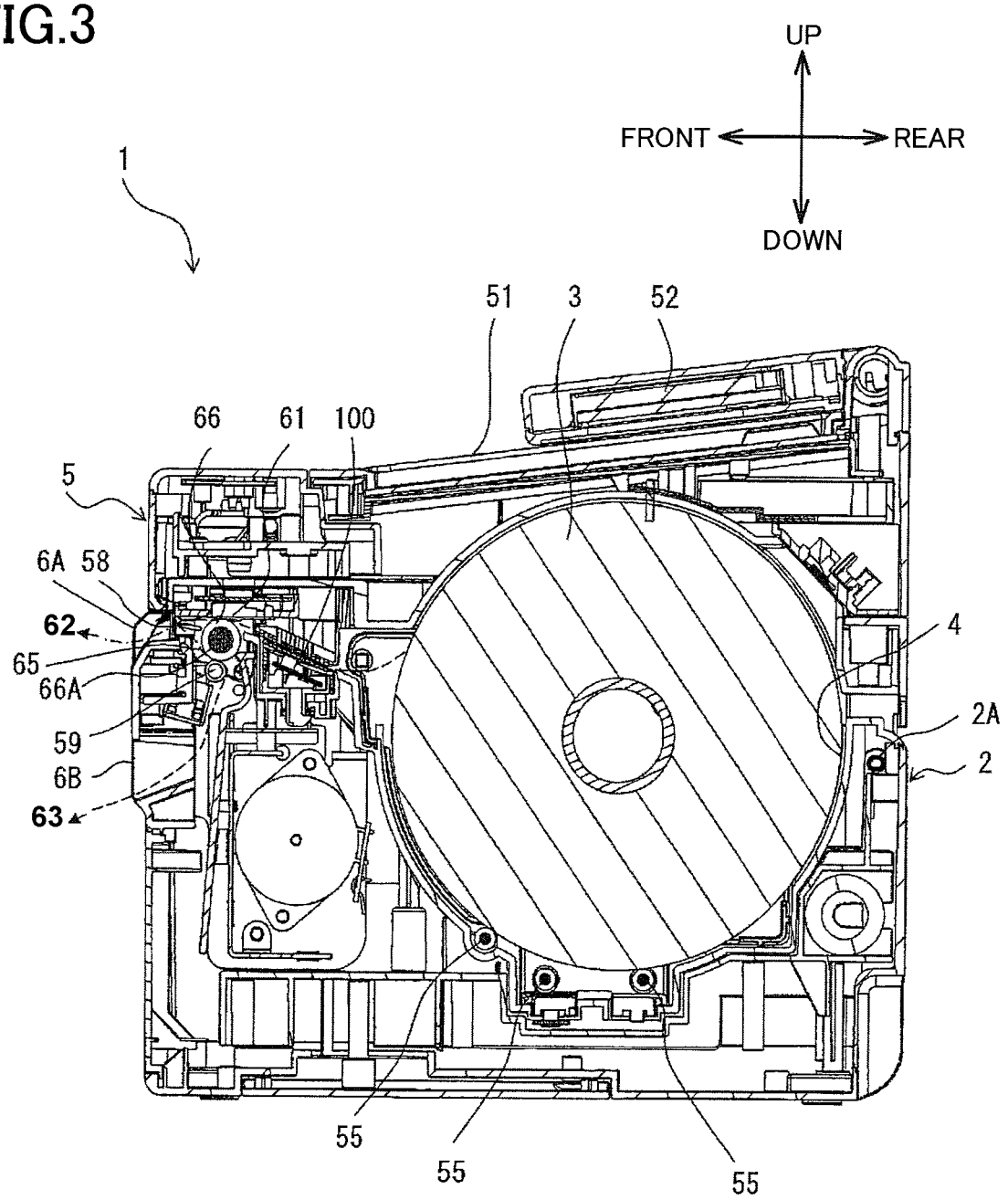
FIG. 3 is an elevational view in vertical cross section of the printing apparatus.

Referring to FIGS. 1-3, a printing apparatus 1 according to one embodiment will be explained. In the following explanation, a lower left side, an upper right side, an upper left side, a lower right side, an upper side, and a lower side in FIGS. 1 and 2 are respectively defined as a front side, a rear side, a left side, a right side, an upper side, and a lower side of the printing apparatus 1. The printing apparatus 1 is a label printer configured to create a label by printing, on a long-length tape 30, various characters such as letters, numerals, symbols, and figures.

The printing apparatus 1 includes: a housing 2 having a front panel 6 and a top cover unit 5. The top cover unit 5 is configured to rotate about a rotation shaft portion 2A (FIG. 3) provided at a rear end portion of the housing 2, so as to be opened and closed relative to the housing 2. Release tabs 17 are respectively provided on a right side and a left side of the housing 2. When the release tabs 17 are pushed up, locking of the top cover unit 5 to the housing 2 is released, so that the top cover unit 5 can be opened.

The top cover unit 5 includes a touch panel 51, a substantially rectangular liquid crystal panel 52, and an operation button portion 53. The touch panel 51 is provided on an upper surface of the top cover unit 5. A user can input various sorts of information (e.g., a label image including various characters to be printed) by a touch operation on the touch panel 51. The liquid crystal panel 52 is provided rearward of the touch panel 51 and displays various sorts of information. The operation button portion 53 is provided at a front end portion of the upper surface of the top cover unit 5. The operation button portion 53 includes a power button, a status button, a feed button, etc.

A first discharge opening 6A and a second discharge opening 6B are formed in the front panel 6. The second discharge opening 6B is located below the first discharge opening 6A. In a state in which the top cover unit 5 is closed relative to the housing 2, the first discharge opening 6A is defined by a front-surface-side upper peripheral portion of the housing 2 and a front-surface-side lower peripheral portion of the top cover unit 5. A cutter 8 is disposed inward of the lower peripheral portion of the top cover unit 5 near the first discharge opening 6A, so as to face downward.

As shown in FIGS. 2 and 3, the printing apparatus 1 includes a roll accommodating portion 4 in the form of a recess at a rear portion of an inner space of the housing 2. The roll accommodating portion 4 is configured to accommodate a roll 3 formed by rolling the tape 30 for label printing. A center axis (winding center) of the roll 3 accommodated in the roll accommodating portion 4 extends in the right-left direction, and the roll 3 is rotatable about the center axis. A plurality of support rollers 55 are provided on a bottom surface of the roll accommodating portion 4. When the platen roller 66 is driven and rotated, the support rollers 55 come into contact with an outer circumferential surface of the tape 30 drawn from the roll 3 and are rotated by rotation of the platen roller 66.

Figure 5:
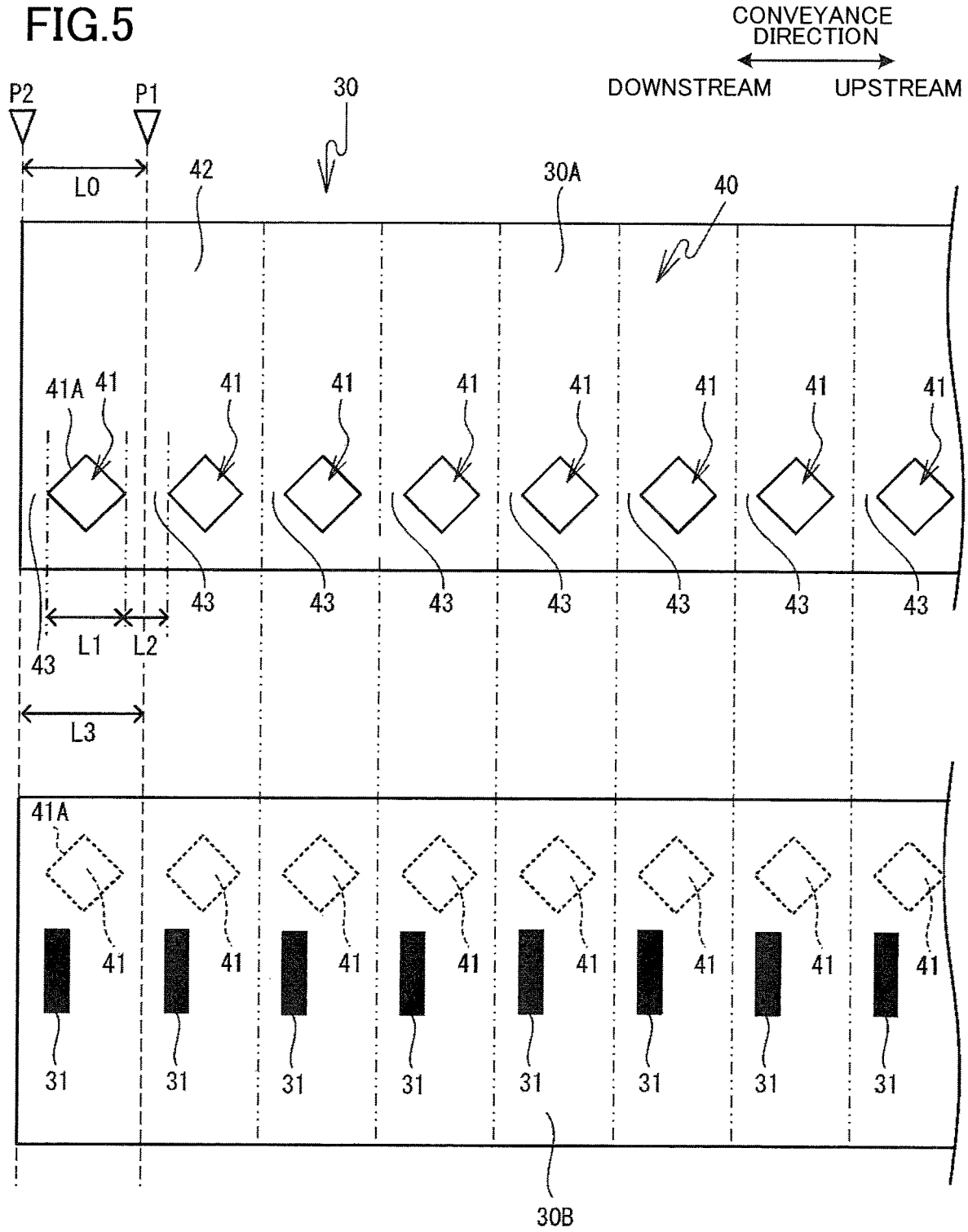
FIG. 5 is a front view and a rear view of a tape.

Two surfaces of the tape 30 are a printing surface 30A and a reverse surface 30B (FIG. 5). The printing surface 30A includes a printing area 40 (FIG. 5) in which characters are to be printed. The reverse surface 30B includes a plurality of reference portions 31 (FIG. 5) for identifying a position of the printing area 40. The roll 3 is formed by rolling the tape 30 into the roll form such that the printing surface 30A faces radially inward.

A pair of guides 20A, 20B are provided in the roll accommodating portion 4 so as to face each other in the right-left direction. The guide 20A is plate-like member contactable with a right end face 3R of the roll 3 accommodated in the roll accommodating portion 4. The guide 20B is a plate-like member contactable with a left end face 3L of the roll 3 accommodated in the roll accommodating portion 4. The guides 20A, 20B are movable toward and away each other in the right-left direction. The positions of the guides 20A, 20B in the right-left direction are adjusted in accordance with a width of the roll 3 accommodated in the roll accommodating portion 4, namely, a width of the tape 30. In this configuration, the guides 20A, 20B guide, in the width direction, the tape 30 drawn from the roll 3 while sandwiching the roll 3 accommodated in the roll accommodating portion 4 from both the right side and the left side.

A print head 61 is disposed on an underside of a front end portion of the top cover unit 5. The print head 61 of the present embodiment is a thermal head configured to perform monochrome printing on the tape 30. The platen roller 66 is disposed at an upper portion of a front end portion of the housing 2 so as to face the print head 61 in the up-down direction. A roller shaft 66A of the platen roller 66 is rotatably supported by brackets 65 provided at both ends of the roller shaft 66A in the axial direction. A gear (not shown) for driving the platen roller 66 is fixed to one end of the roller shaft 66A.

When the top cover unit 5 is closed relative to the housing 2, the tape 30 on a conveyance path is nipped by and between the print head 61 and the platen roller 66, so that the print head 61 can perform printing on the tape 30. Further, the gear fixed to the roller shaft 66A is brought into engagement with a gear train (not shown) provided in the housing 2, so that a conveyance motor 214 (FIG. 4) which is a stepping motor enables the platen roller 66 to rotate. It is noted that a position at which the print head 61 performs printing on the tape 30 is referred to as a head printing position P1 (FIG. 5). The head printing position P1 is one example of a first position.

A separating plate 58 is disposed forward of the platen roller 66. In the case where the tape 30 is a label tape having a three-layer structure that includes a printing layer, an adhesive layer, and a release layer, the separating plate 58 can peel off the release layer from the printed tape 30. A pinch roller 59 is disposed below the platen roller 66. The release layer which is folded back downward by the separating plate 58 is nipped by and between the pinch roller 59 and the platen roller 66.

In a state in which the top cover unit 5 is closed relative to the housing 2, the user instructs a start of printing through the touch panel 51. When the conveyance motor 214 drives and rotates the platen roller 66, the tape 30 is drawn from the roll 3 while being guided by the guides 20A, 20B. The print head 61 performs printing on the tape 30 drawn from the roll 3, and the printed tape 30 is discharged outside the housing 2 from the first discharge opening 6A via the separating plate 58 (as indicated in the long dashed short dashed line 62 in FIG. 3). The printed tape 30 is cut by the cutter 8. In the present embodiment, the printing apparatus 1 is configured to perform full cut in which the tape 30 is cut across the thickness direction of the tape 30, in other words, the tape 30 is fully cut in the thickness direction, and half cut in which the tape 30 is cut partly in the thickness direction of the tape 30. Here, a position at which the cutter 8 cuts the tape 30 is referred to as a cutter cut position P2 (FIG. 5). The cutter cut position P2 is one example of a second position.

In the case where the tape 30 is the label tape, the release layer can be peeled off from the printed tape 30 by the separating plate 58. The peeled release layer is discharged by the pinch roller 59 outside the housing 2 from the second discharge opening 6B (as indicated by the dashed line 63 in FIG. 3). The printing layer and the adhesive layer of the tape 30 are discharged outside the housing 2 from the first discharge opening 6A and cut by the cutter 8 (as indicated by the long dashed short dashed line 62 in FIG. 3). In the present embodiment, an example is illustrated in which the tape 30 as the label tape is discharged outside the housing 2 from the first discharge opening 6A without the release layer being peeled off by the separating plate 58.

Referring next to FIGS. 2 and 3, a reflective sensor 100 will be explained. The reflective sensor 100 is disposed in a sensor mount portion 102 in the form of a recess formed between the platen roller 66 and the roll accommodating portion 4. A reflective surface 101 is provided on a lower surface of the top cover unit 5 on a downstream side of the print head 61 in the conveyance direction. The reflective surface 101 is a surface portion in a specific color (e.g., black). When the top cover unit 5 is closed relative to the housing 2, the reflective sensor 100 and the reflective surface 101 face each other with the conveyance path of the tape 30 interposed therebetween.

Like a known reflective sensor, the reflective sensor 100 includes a light emitting portion and a light receiving portion (both not shown). The light emitting portion emits detection light toward the reflective surface 101. In the case where the tape 30 is present on the conveyance path, the emitted detection light is reflected by the tape 30 and the reflected light is received by the light receiving portion. In the case where the tape 30 is not present on the conveyance path, the emitted detection light is reflected by the reflective surface 101 and the reflected light is received by the light receiving portion. The amount of the reflected light received by the light receiving portion changes depending upon by which one of the tape 30 and the reflective surface 101 the detection light is reflected and depending upon the color of the portion of the tape 30 to which the detection light is applied.

A CPU 201 (FIG. 4) of the printing apparatus 1 is configured to detect the reference portions 31 in accordance with the results by the reflective sensor 100 and to execute various print controls based on the detected reference portions 31. The CPU 201 is configured to identify, based on the detected reference portions 31, positions in the printing area 40 at which characters are to be printed. For instance, the CPU 201 is configured to identify positions of first printing regions 41 (FIG. 5) corresponding to the respective reference portions 31, so that a character is printable in each of the identified first printing regions 41. The CPU 201 is configured to identify, based on the detected reference portions 31, positions in a second printing region 42 (FIG. 5) at which respective characters are to be printed, so that characters are printable at the identified positions.

Figure 4:
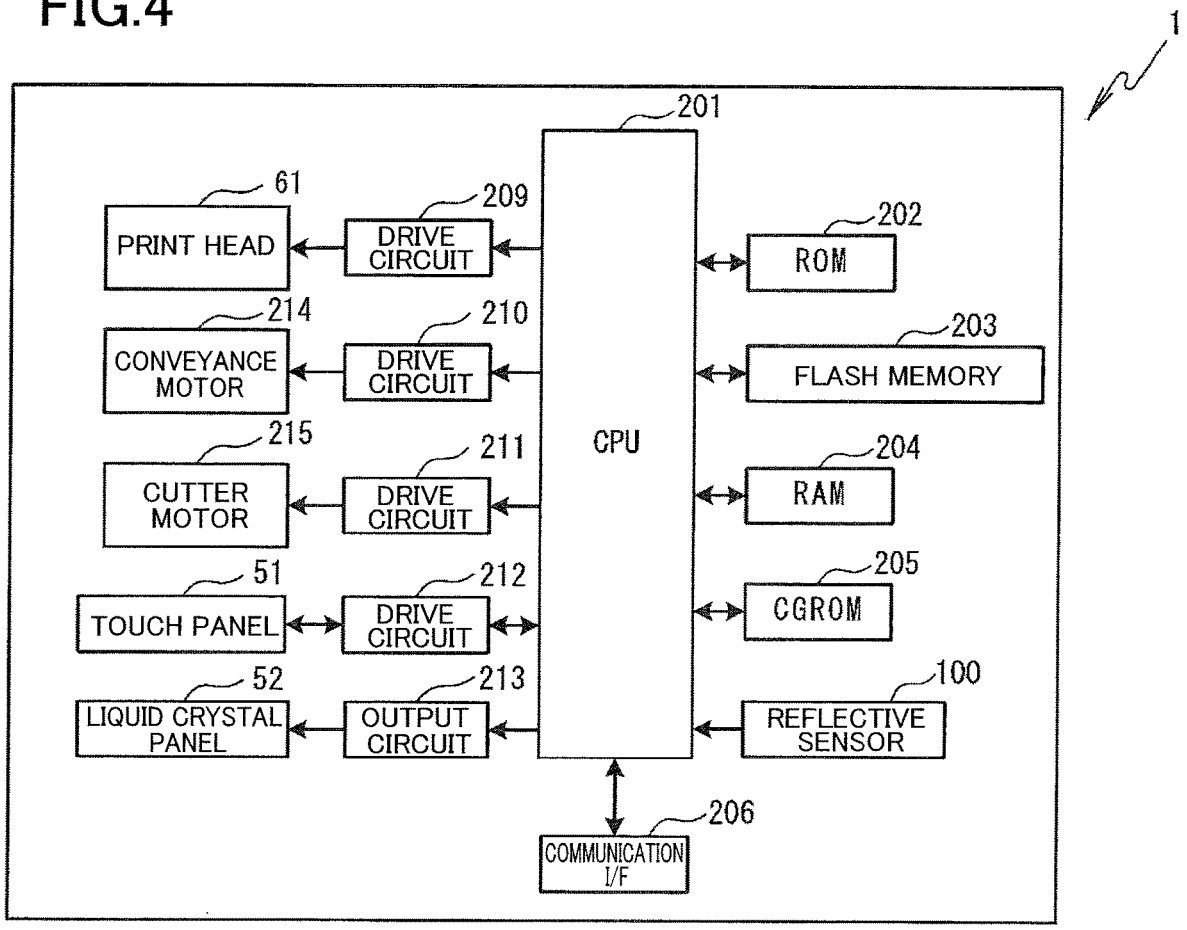
FIG. 4 is a block diagram illustrating an electrical configuration of the printing apparatus.

Referring next to FIG. 4, an electrical configuration of the printing apparatus 1 will be explained. The printing apparatus 1 includes the CPU 201 configured to control the printing apparatus 1. The CPU 201 is connected to a ROM 202, a flash memory 203, a RAM 204, a CGROM 205, a communication I/F 206, drive circuits 209-212, an output circuit 213, and the reflective sensor 100. The ROM 202 stores programs executed by the CPU 201. The flash memory 203 is a nonvolatile memory and stores various sorts of information. The RAM 204 stores temporal data including various variables which will be later explained. The CGROM 205 stores dot pattern data for printing the characters on the tape 30.

The drive circuit 209 is an electronic circuit for driving the print head 61. The drive circuit 210 is an electronic circuit for driving the conveyance motor 214. The drive circuit 211 is an electronic circuit for driving a cutter motor 215 configured to operate the cutter 8. The drive circuit 212 is an electronic circuit for driving the touch panel 51. The output circuit 213 is an electronic circuit for executing displaying control of the liquid crystal panel 52.

The tape 30 of the present embodiment will be explained with reference to FIG. 5. A lengthwise direction of the tape 30 is parallel to the conveyance direction of the tape 30. A short-side direction of the tape 30 is parallel to a width direction of the tape 30. In the reverse surface 30B shown in FIG. 5, a plurality of first printing regions 41 provided on the printing surface 30A are indicated by the dotted line.—(The first printing regions in FIG. 12 that will be later explained are also indicated by the dotted line.)

A major surface of the tape 30 is the printing surface 30A which is one surface of the printing layer. The printing surface 30A includes the printing area 40 in which characters are printable. The printing area 40 includes the plurality of first printing regions 41 arranged parallel to the conveyance direction and the second printing region 42 different from the first printing regions 41. The printing surface 30A further includes a plurality of intermediate regions 43 each of which is disposed between adjacent two of the first printing regions 41. In the present embodiment, the first printing regions 41 are disposed so as to be shifted from a widthwise center of the tape 30 toward one end side in the width direction of the tape 30, i.e., toward a lower side in FIG. 5, and are arranged in the conveyance direction so as to be equally spaced apart from one another.

In each of the first printing regions 41, a region marker 41A is printed in advance in a color different from the color (black) in which characters are printed by the print head 61. The region marker 41A is an image indicating a region in which a first character (which will be explained) is allowed to be printed. In the present embodiment, the region marker 41A is a rhombic frame. The outline of the region marker 41A is red, and an inner region defined by the outline is white. In other words, in the printing area 40, regions at which the region markers 41A are disposed correspond to the first printing regions 41. Each of the intermediate regions 43 is a space interposed between corresponding two of the first printing regions 41 that are arranged next to each other in the conveyance direction. The second printing region 42 is a region in the printing surface 30A except the plurality of first printing regions 41 and the plurality of intermediate regions 43.

A length in the conveyance direction of each first printing region 41 (i.e., a length in the conveyance direction of each region marker 41A) is a length L1. In the present embodiment, the length L1 is smaller than a reference distance L0. The reference distance L0 (as one example of a second distance) is a distance between the head printing position P1 and the cutter cutting position P2 in the conveyance direction. A length L2 is a distance between an upstream end of a downstream one of two of the plurality of first printing regions 41 which are next to each other in the conveyance direction and a downstream end of an upstream one of the two of the plurality of first printing regions 41. In other words, the length L2 is a length of each intermediate region 43 in the conveyance direction. In the present embodiment, the length L2 is smaller than the length L1. A length in the conveyance direction obtained by adding the length L1 and the length L2 is a length L3. The length L3 (as one example of a first distance) is equal to a distance between an upstream end of an upstream one of two of the plurality of intermediate regions 43 which are next to each other in the conveyance direction and an upstream end of a downstream one of the two of the plurality of intermediate regions 43. In the present embodiment, the length L3 is equal to the reference distance L0.

The back surface of the tape 30 is the reverse surface 30B which is one surface of the release layer. The reverse surface 30B includes the plurality of reference portions 31 arranged parallel to the conveyance direction. In the present embodiment, the reference portions 31 are provided at the widthwise center of the tape 30 and are arranged in the conveyance direction so as to be equally spaced apart from one another. The number of the reference portions 31 is the same as the number of the first printing regions 41. Each reference portion 31 is a rectangular black mark that is elongate in the width direction of the tape 30. The reference portions 30 are printed on the reverse surface 30B in advance. The position of a downstream end of each reference portion 31 in the conveyance direction is the same as the position of a downstream end of the corresponding first printing region 41 in the conveyance direction.

Figure 6:
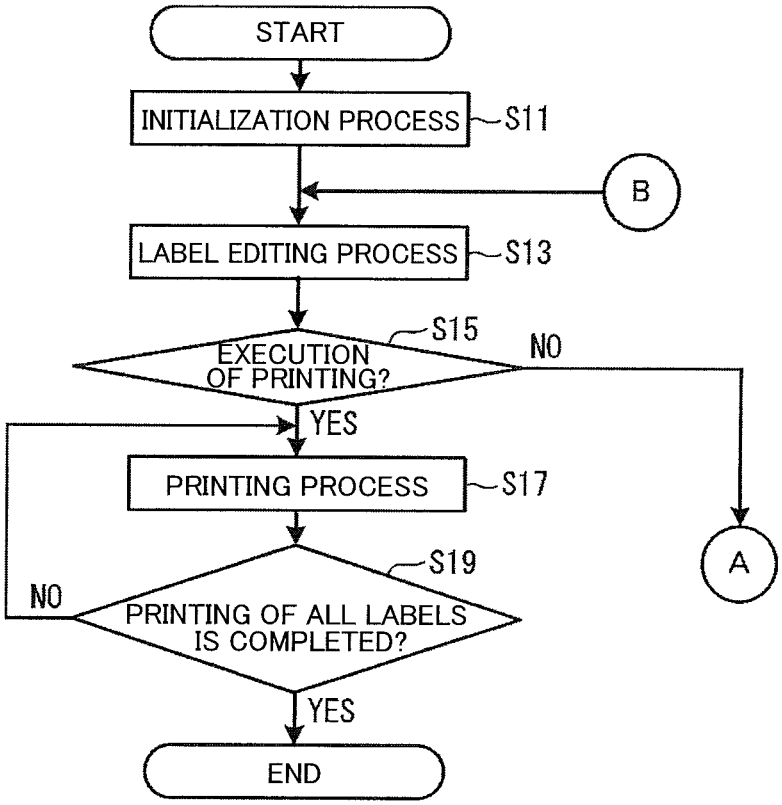
FIG. 6 is a part of a flowchart indicating a main process.
Figure 7:
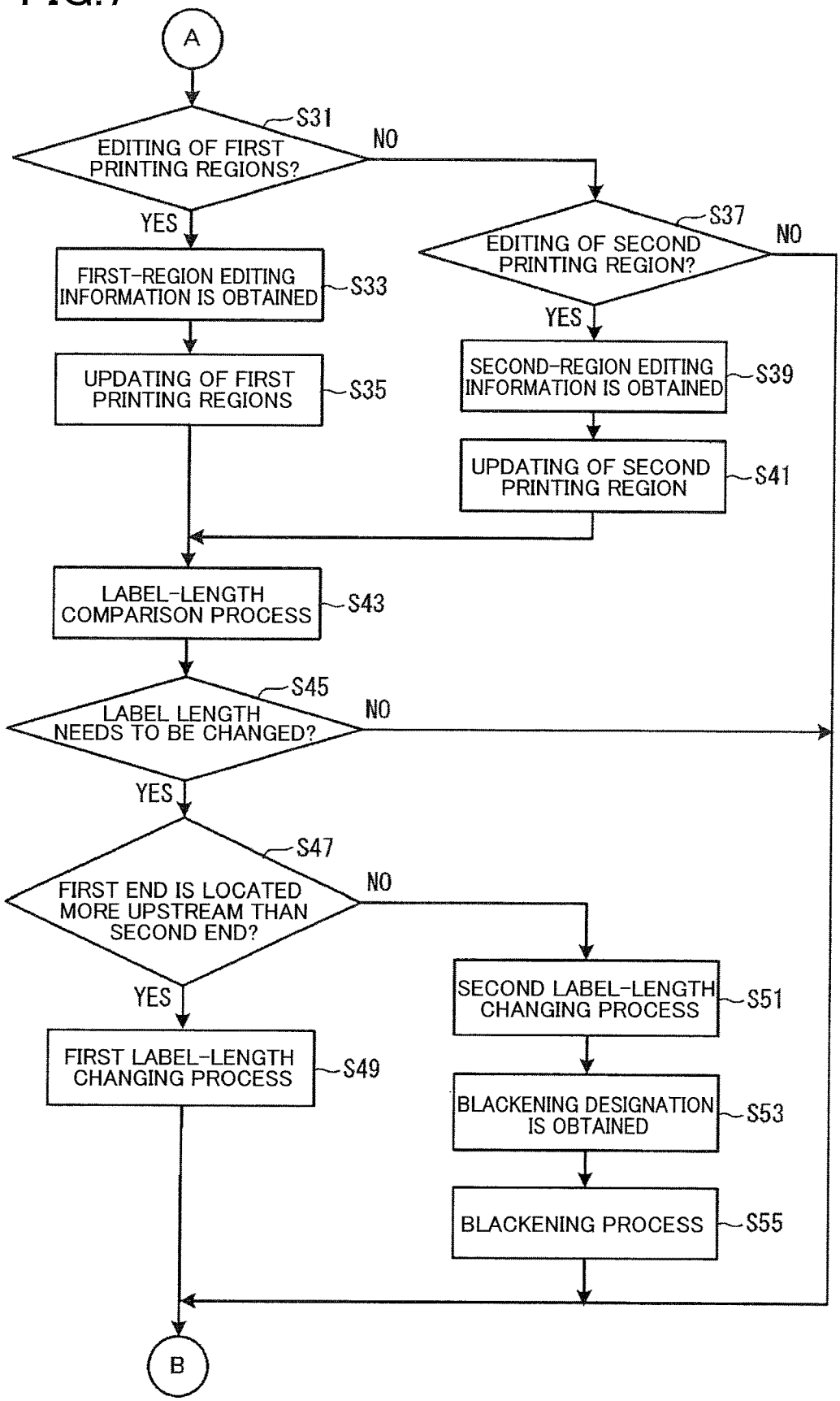
FIG. 7 is another part of the flowchart indicating the main process.

Referring next to FIGS. 6 and 7, a main process executed in the printing apparatus 1 will be explained. When the user instructs the printing apparatus 1 to start label editing, the CPU 201 reads out the program stored in the ROM 202 and executes the main process. As shown in FIG. 6, there is executed an initialization process similar to that known in the art (S11). For instance, the CPU 201 initializes flags and initial values of variables stored in the RAM 204 and performs operation checking of the print head 61, the reflective sensor 100, and so on. There are set, in the RAM 204, default values of a letter font, a letter size, a label length, etc. The default values of the letter font, the letter size, the label length, etc., set in the RAM 204 can be freely changed by the user in a label editing process explained below.

Subsequently, the label editing process is executed (S13). In the label editing process, the user operates the touch panel 51 to edit a label image to be printed on the tape 30. In this instance, the user sets at least one character (each as a first character) to be printed in at least one of the plurality of first printing regions 41 and sets characters (as second characters) to be printed in the second printing region 42. In other words, the user designates, among the plurality of first printing regions 41, at least one first printing region 41 (each as a printing target region) in each of which the corresponding first character is to be printed. The label image edited in the label editing process is stored in the RAM 204.

Figure 8A:
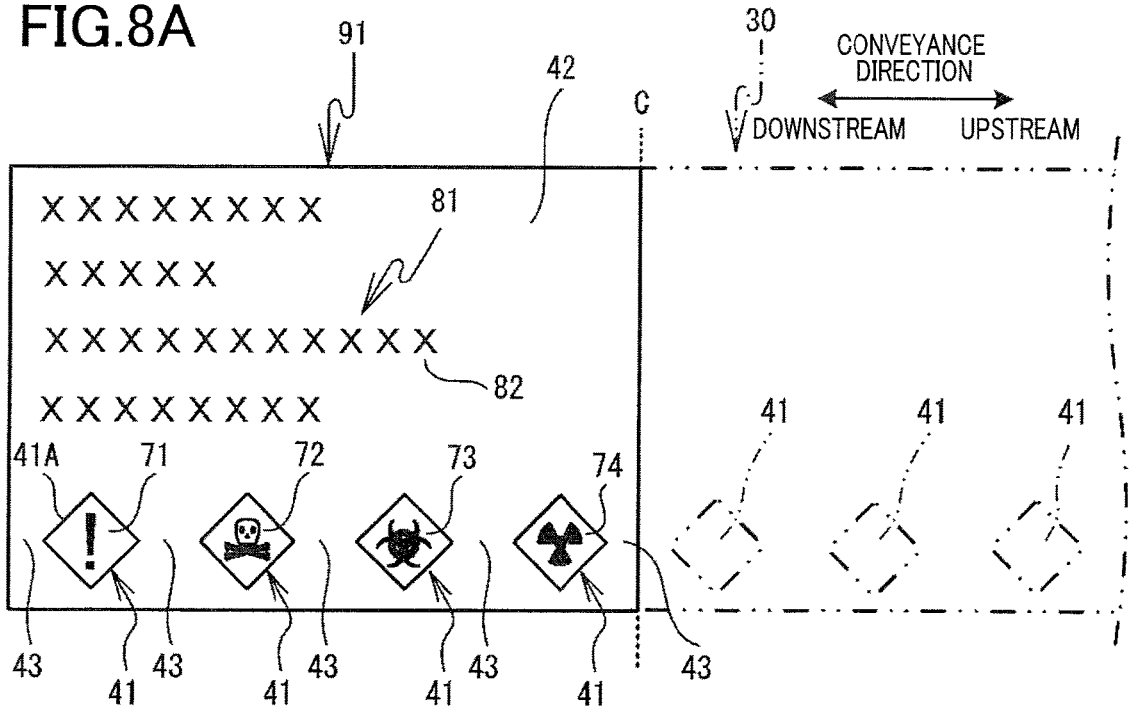
FIGS. 8A and 8B respectively illustrate a label 91 and a label 92 which are created by the printing apparatus.
Figure 8B:
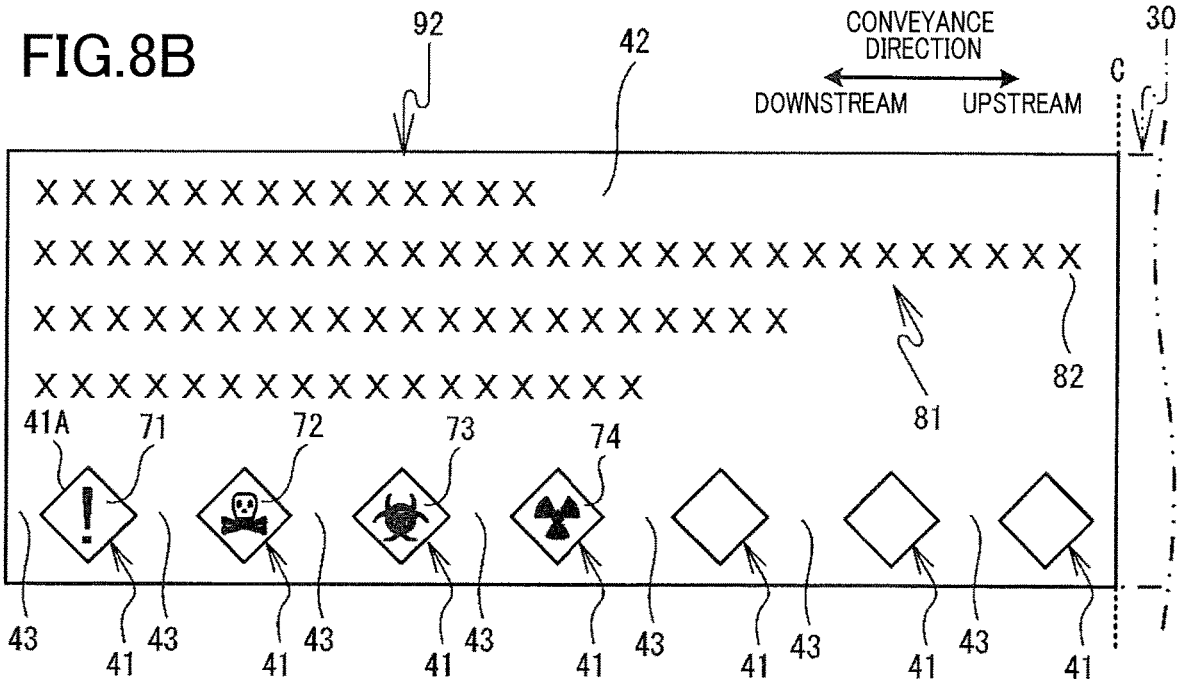

In examples shown in FIGS. 8A and 8B, the user sets, in the label image, four first characters 71-74 respectively for four first printing regions 41 arranged in the conveyance direction. Each of the first characters 71-74 is a symbol image that can be printed within the region marker 41A of the corresponding first printing region 41. The user sets, in the label image, a text 81 constituted by the second characters (such as letters, symbols, and figures) for the second printing region 42.

Subsequently, it is determined whether execution of printing is instructed (S15). In the case where the user operates the touch panel 51 and instructs execution of printing of the edited label image, it is determined that the execution of printing is instructed (S15: YES). On the other hand, in the case where the execution of printing is not instructed (S15: NO), it is determined whether editing of the first printing regions 41 is performed, as shown in FIG. 7 (S31). In the case where any of the first printing regions 41 is edited in the label editing process, it is determined that the editing of the first printing regions 41 is performed (S31: YES).

In this case, first-region editing information is obtained (S33). The first-region editing information is information indicating contents of edition performed on the first printing regions 41. For instance, the first-region editing information indicates positions and the number of the first printing regions 41 in each of which the corresponding first character is set, contents of the set first characters, etc. Subsequently, in the label image stored in the RAM 204, data of the currently edited first printing regions 41 is updated based on the obtained first-region editing information (S35).

On the other hand, in the case where the editing of the first printing regions 41 is not performed (S31: NO), it is determined whether editing of the second printing region 42 is performed (S37). In the case where the second printing region 42 is edited in the label editing process, it is determined that the editing of the second printing region 42 is performed (S37: YES). In this case, second-region editing information is obtained (S39). The second-region editing information is information indicating contents of edition performed on the second printing region 42. For instance, the second-region editing information indicates positions, sizes, contents, etc., of the second characters set for the second printing region 42. Subsequently, in the label image stored in the RAM 42, data of the currently edited second printing region is updated based on the obtained second-region editing information (S41).

After S35 or S41, a label-length comparison process is executed (S43). In the label-length comparison process, it is determined which one of an upstream end (hereinafter referred to as a first end) of a tail printing region and an upstream end (hereinafter referred to as a second end) of a tail character is located more upstream in the conveyance direction, in the label image stored in the RAM 204. The tail printing region is the most upstream first printing region 41 in the conveyance direction among the first printing regions 41 in each of which the corresponding first character is set. The tail character is the most upstream second character in the conveyance direction among the second characters set in the second printing region 42. One of the first end and the second end that is located more upstream in the conveyance direction is set as a label-length setting reference.

Next, it is determined whether the label length needs to be changed (S45). Specifically, it is determined whether an upstream end portion of the label image stored in the RAM 204 is present in a cutting target region. The cutting target region is one of the intermediate regions 43 that is located immediately upstream of the label-length setting reference explained above. In the case where the upstream end portion of the label image is not present in the cutting target region, it is determined that the label length needs to be changed (S45: YES).

In this instance, it is determined whether the first end is located more upstream than the second end (S47). In the case where the label-length setting reference set at S43 is the first end, it is determined that the first end is located more upstream than the second end (S47: YES), and a first label-length changing process is executed (S49). In the first label-length changing process, the label length of the label image stored in the RAM 204 is changed such that the upstream end portion of the label image is set in the cutting target region (i.e., the first end). Thus, the upstream end portion of the label image being edited is set in one of the intermediate regions 43 that is located immediately upstream of the first end.

On the other hand, in the case where the label-length setting reference set at S43 is the second end, the first end is not located more upstream than the second end (S47: NO), and a second label-length changing process is executed (S51). In the second label-length changing process, the label length of the label image stored in the RAM 204 is changed such that the upstream end portion of the label image is set in the cutting target region (i.e., the second end). Thus, the upstream end portion of the label image being edited is set in one of the intermediate regions 43 that is located immediately upstream of the second end.

In the case where the second end is located more upstream than the first end, there may be an instance in which at least one non-used first printing region 41 for each of which the corresponding first character is not set is present in the label image being edited. In such an instance, the user may input, in the label editing process (S13), a blackening designation to designate blackening of the at least one non-used first printing region 41. The blackening designation indicates each position of the at least one non-used first printing region 41 to be blackened out. The blackening designation is stored in the RAM 204.

After S51, in the case where the blackening designation is stored in the RAM 204, the blackening designation in question is obtained (S53). In this instance, the label image that is stored in the RAM 204 and that is being currently edited is updated such that the at least one non-used first printing region 41 is blackened out based on each position indicated by the blackening designation (S55). After S49 or S55, the control flow returns to S13. In the case where the blackening designation is not stored in the RAM 204, S53-S55 are skipped, and the control flow returns to S13. In the case where the editing of the second printing region 42 is not performed (S37: NO), the control flow returns to S13. In the case where the label length need not be changed (S45: NO), the control flow returns to S13 without changing the label length of the label image stored in the RAM 204.

As shown in FIG. 6, in the case where the execution of printing is instructed (S15: YES), a printing process is executed (S17). At S17, print data of the label image stored in the RAM 204 is created, and a printing operation described below is performed based on the print data. That is, an image is printed on the tape 30 at the head printing position P1 while the tape 30 is conveyed downstream in the conveyance direction by forward driving of the conveyance motor 214. In this instance, the print head 61 prints the label image stored in the RAM 204 on the printing surface 30A from a downstream end portion of the tape 30 toward the upstream side. The corresponding first character is printed in each of the at least one first printing region 41 each designated as the printing target region for any first character, and the second characters are printed in the second printing region 42. As described above, the printing apparatus 1 identifies positions in the printing area 40 at which the characters are to be printed, based on the reference portions 31 detected by the reflective sensor 100.

When the label image is printed, printing performed last on a tail printing region among the at least one first printing region 41 for each of which the corresponding first character is set, and a tail character is printed last among the second characters included in the second printing region. Each first character is printed so as to be disposed inside the region marker 41A of the corresponding first printing region 41. That is, the size of each first character to be printed is smaller than or equal to a size of the corresponding first printing region 41 in which the first character is to be printed. The tape 30 on which the label image is printed is stopped being conveyed and cut when the cutting target region reaches the cutter cutting position P2. In the present embodiment, the tape 30 is cut along the width direction so as to pass a center in the conveyance direction of the intermediate region 43 as the cutting target region. In this way, the label on which the label image has been printed is created and discharged through the first discharge opening 6A. Thus, the printing operation for one label is completed.

In the present embodiment, the cutter 8 performs the full cut of the tape 30. The cutter 8 may perform the half cut of the tape 30. In the case where the user instructs printing of a plurality of labels, the printing operation is executed until the instructed number of the labels are created (S19: NO, S17). When printing of all of the labels is completed (S19: YES), the main process is ended.

In the example of FIG. 8, an upstream end of the first printing region 41 (as the tail printing region) in which the first character 74 is set corresponds to the first end, and an upstream end of a tail character 82 included in the text 81 corresponds to the second end. In the example of FIG. 8A, the first end is located more upstream than the second end in the conveyance direction (S47: YES). In this case, a cutting target region C is set at one of the intermediate regions 43 that is located immediately upstream of the first end (as one example of a first intermediate region), and the label length is accordingly changed (S49). After the label image is printed on the tape 30, the tape 30 is cut at the cutting target region C (as one example of a first cutting target position) along the width direction, whereby a label 91 is created (S17).

In the example of FIG. 8B, the second end is located more upstream than the first end in the conveyance direction (S47: NO). In this case, the cutting target region C is set at one of the intermediate regions 43 that is located immediately upstream of the second end (as one example of a second intermediate region), and the label length is accordingly changed (S51). In the example of FIG. 8B, there exist three non-used first printing regions 41 between the first end and the cutting target region C (as one example of a second cutting target position). In the case where the blackening designation is not input, the tape 30 on which the label image is printed is cut along the width direction so as to pass the cutting target region C. As a result, a label 92 is created in which the three non-used first printing regions 41 are indicated as they are (S17).

Figure 9A:
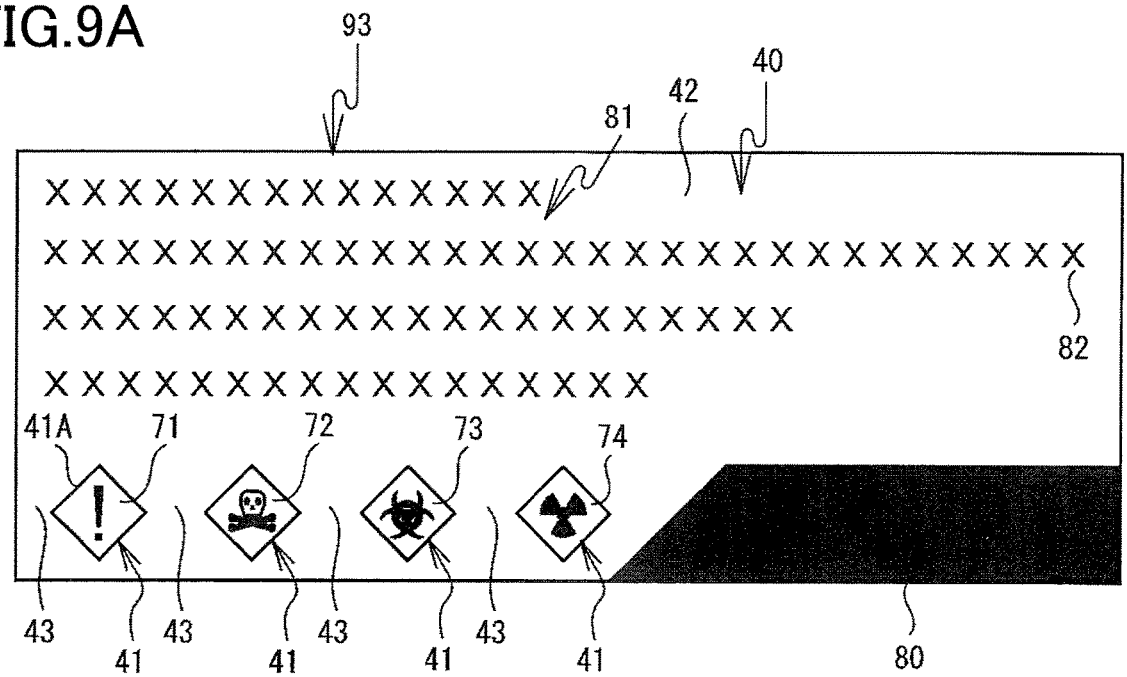
FIGS. 9A and 9B respectively illustrate a label 93 and a label 94 which are created by the printing apparatus.

In the example of FIG. 9A, there exist three non-used first printing regions 41 as in the example of FIG. 8B, and the blackening designation for those three non-used first printing regions 41 is input (S53, S55). In this instance, in the printing operation of the label image, solid printing in black is performed to cover the non-used first printing regions 41, and thereafter the tape 30 is cut along the width direction so as to pass the cutting target region C. As a result, a label 93 is created in which is printed a covering image 80 that covers the non-used first printing regions 41.

In each of the labels 91-93, the label image is formed to have a minimum label length that enables printing of all of the first characters and the second characters included in the label image. It is thus possible to reduce, in each of the labels 91-93, an unnecessary margin at a tail portion thereof not used for printing of the characters. As described above, the length L3 is equal to the reference distance L0 in the present embodiment. Accordingly, when the tape 30 is stopped being conveyed and is fully cut in the thickness direction at the cutter cutting position P2 (the full cut), one of the intermediate regions 43 that is located immediately upstream in the conveyance direction with respect to the cutter cutting position P2 is located at the head printing position P1 (FIG. 5).

Figure 9B:
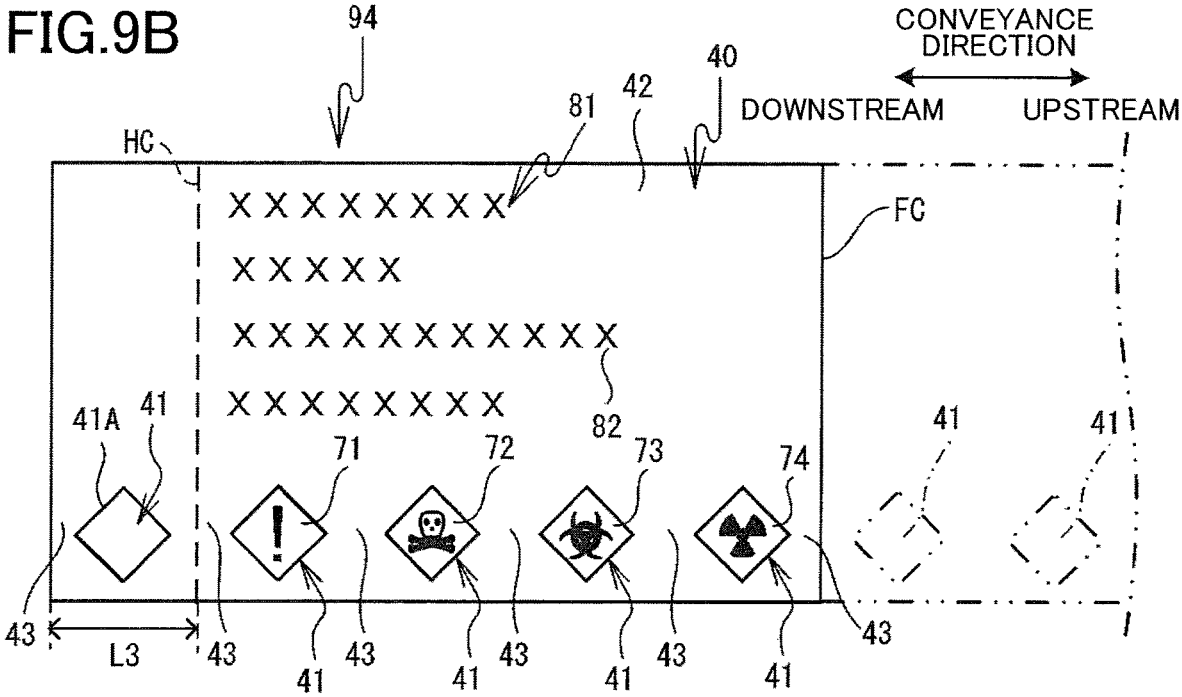

In this instance, the printing apparatus 1 starts printing a next label image while conveying the tape 30 by a distance corresponding to the length L3 toward the downstream side in the conveyance direction without winding back the tape 30. Thereafter, the printing apparatus 1 stops conveying the tape 30 and performs the half cut of the tape 30 at the cutter cutting position P2. (See the dotted line HC in FIG. 9B.) Further, the printing apparatus 1 performs printing while conveying the tape 30 until printing of the label image is completed. Thereafter, the printing apparatus 1 stops conveying the tape 30 and performs the full cut of the tape 30 at the cutting target region C. (See the solid line FC in FIG. 9B.) In this way, a margin present at a head portion of the tape 30 (hereinafter referred to as a "head margin" where appropriate) corresponding to the length L3 is demarcated or delimited, and the label image is successively printed without winding back the tape 30, so that a plurality of labels are created. In the example of FIG. 9B, a label 94 in which a label image similar to that of the label 91 is printed can be created without winding back the tape 30 after preceding label printing has been performed.

The printing apparatus 1 of the present embodiment includes the conveyance motor 214 (as one example of a component of a conveyor), the print head 61, the cutter 8, and the CPU 201 (as one example of a controller). The conveyance motor 214 conveys the tape 30 including the printing surface 30A in the predetermined conveyance direction. The print head 61 performs printing, at the head printing position P1, on the tape 30 conveyed by the conveyance motor 214. The cutter 8 cuts the tape 30 at the cutter cutting position P2 located more downstream than the head printing position P1 in the conveyance direction. The CPU 201 controls the printing operation based on the print data of the label image including the at least one first character and the second characters.

The printing surface 30A includes the plurality of first printing regions 41 arranged in the conveyance direction and the second printing region 42 different from the plurality of first printing regions 41. The CPU 201 performs, as the printing operation, causing the print head 61 to print one of the at least one first character in each of at least one of the plurality of first printing regions 41 and to print the second characters in the second printing region 42 while causing the conveyance motor 214 to convey the tape 30, so as to print the label image on the tape 30, and causing the cutter 8 to cut the tape 30 on which the label image is printed (S17), so as to create the label.

The tape 30 on which the label image is printed includes the first end and the second end. The first end is the upstream end of the tail printing region which is one of the plurality of first printing regions 41 in which one of the at least one first character is lastly printed. The second end is the upstream end of the tail character which is the most upstream one of the second characters printed in the second printing region 42. In the case where the first end is located more upstream than the second end, the CPU 201 causes the cutter 8 to cut the tape 30 at the intermediate region 43 that is located upstream of the first end (S47: YES, S49, S17). In the case where the second end is located more upstream than the first end, the CPU 201 causes the cutter 8 to cut the tape 30 at the intermediate region 43 that is located upstream of the second end (S47: NO, S51, S17).

In this configuration, one of the first end and the second end of the label image that is located more upstream in the conveyance direction is set as the label-length setting reference, and the tape 30 is cut at a position located upstream of the label-length setting reference in the conveyance direction. As a result, the labels 91-94 can be created in each of which all of the first characters and the second characters are appropriately printed. Further, because the tape 30 is cut at the intermediate region 43 that is immediately upstream of the label-length setting reference, the created labels 91-94 have a reduced margin at a tail portion thereof (hereinafter referred to as a "tail margin" where appropriate) which is not used in printing of the characters. Thus, the printing apparatus 1 is capable of creating the label in which the characters are appropriately printed both in the first printing regions 41 and the second printing region 42 using the tape 30 on which a format indicating the first printing regions 41 is printed in advance.

The printing surface 30A includes the plurality of intermediate regions 43 each of which is located between adjacent two of the plurality of first printing regions 41. The printing apparatus 1 cuts the tape 30 at one of the intermediate regions 43 that is located upstream of the label-length setting reference (the first end or the second end) in the conveyance direction, so as to prevent the tape 30 from being cut at any of the first printing regions 41.

The plurality of intermediate regions 43 include the downstream intermediate region and the upstream intermediate region as the two intermediate regions 43 arranged adjacent to each other with a corresponding one of the first printing regions 41 interposed therebetween. The distance between the upstream end of the downstream intermediate region and the upstream end of the upstream intermediate region in the conveyance direction is equal to the length L3. The distance between the head printing position P1 and the cutter cutting position P2 in the conveyance direction is equal to the reference distance L0. The length L3 and the reference distance L0 are equal to each other. In the period in which the printing operation is being performed, the CPU 201 causes the cutter 8 to cut the tape 30 at the most downstream one of the intermediate regions 43 in the conveyance direction (S17). Thus, the printing apparatus 1 is capable of creating the label 94 having a smaller head margin at a head portion thereof which is not used in the printing of the characters, without winding back the tape 30 after preceding label printing has been performed.

Each of the first printing regions 41 includes the region marker 41A which is an image indicating a region of the printing surface 30A in which one of the first characters is allowed to be printed. The region markers 41A have a color different from colors of the first characters and the second characters to be printed by the print head 61. Thus, the printing apparatus 1 is capable of creating the labels 91-94 which are good in design by printing the first characters based on the region markers 41A.

The plurality of first printing regions 41 have mutually the same length L1 in the conveyance direction. The size of each of the first characters to be printed is smaller than or equal to the size of a corresponding one of the plurality of first printing regions 41 in which each of the first characters is to be printed. Thus, the printing apparatus 1 can appropriately print the first characters in the respective first printing regions 41. In the period in which the printing operation is being performed, the CPU 201 causes the print head 61 to print the covering image 80 that covers at least one non-printed region (e.g., three in the example of FIG. 9A), among the plurality of first printing regions 41, in each of which any first character is not printed. Thus, the printing apparatus 1 is capable of creating the label 94 in which the at least one non-used first printing region 41 is covered and which has good viewability.

The CPU 201 is configured to receive a printing-target-region designating instruction which designates, among the plurality of first printing regions 41, at least one printing target region in each of which the first character is to be printed (S13). When the CPU 201 receives the printing-target-region designating instruction, the CPU 201 causes the print head 61 to print, in the period in which the printing operation is being performed, the first character in each of the at least one designated printing target region (S17). Thus, the printing apparatus 1 is capable of creating the labels 91-94 in each of which the corresponding first character is printed in each of the at least one designated first printing region 41 among the plurality of first printing regions 41.

In the case where the user sets, upon input of the printing-target-region designating instruction, the first characters whose number is smaller than that of the first printing regions 41 included in the label image, the user may specify a position of alignment of the first characters with respect to the first printing regions 41, namely, the user may select one of a downstream-side alignment, a center alignment, and an upstream-side alignment, for instance. Specifically, when the user selects the downstream-side alignment, the input first characters are automatically set for the downstream-side first printing regions 41 of the label image in the conveyance direction. When the user selects the center alignment, the input first characters are automatically set for the central first printing regions 41 of the label image in the conveyance direction. When the user selects the upstream-side alignment, the input first characters are automatically set for the upstream-side first printing regions 41 of the label image in the conveyance direction.

It is to be understood that the present disclosure is not limited to the details of the illustrated embodiment but may be embodied otherwise. For instance, the tape 30 may be a tape constituted by a single printing layer without including the adhesive layer. In the illustrated embodiment, the region markers 41A of the respective first printing regions 41 are mutually the same. A plurality of kinds of region markers 41A which are different in shape or size may be alternately or randomly printed. The length L2 of each intermediate region 43 in the conveyance direction may differ among the plurality of intermediate regions 43. The label may be created such that the tape 30 is cut upstream of one of the intermediate regions 43 that is located immediately upstream of the label-length setting reference. The color of the region markers 41A may be the same as the colors of the characters to be printed by the print head 61. In the illustrated embodiment, each region marker 41A has a frame-like shape having the colored outline and the white inner region defined by the outline. Each region marker 41A may be an image which is entirely printed in halftone (gray) or entirely shaded. As long as each first printing region 41 has a size that allows the region marker 41A to be disposed within the first printing region 41, each first printing region may have any size. As long as each first character to be printed has a size that allows the first character itself to be disposed within the corresponding first printing region 41 as the printing target region of the first character, the size of each first character may be larger than that of the region marker 41A.

Figure 11A:
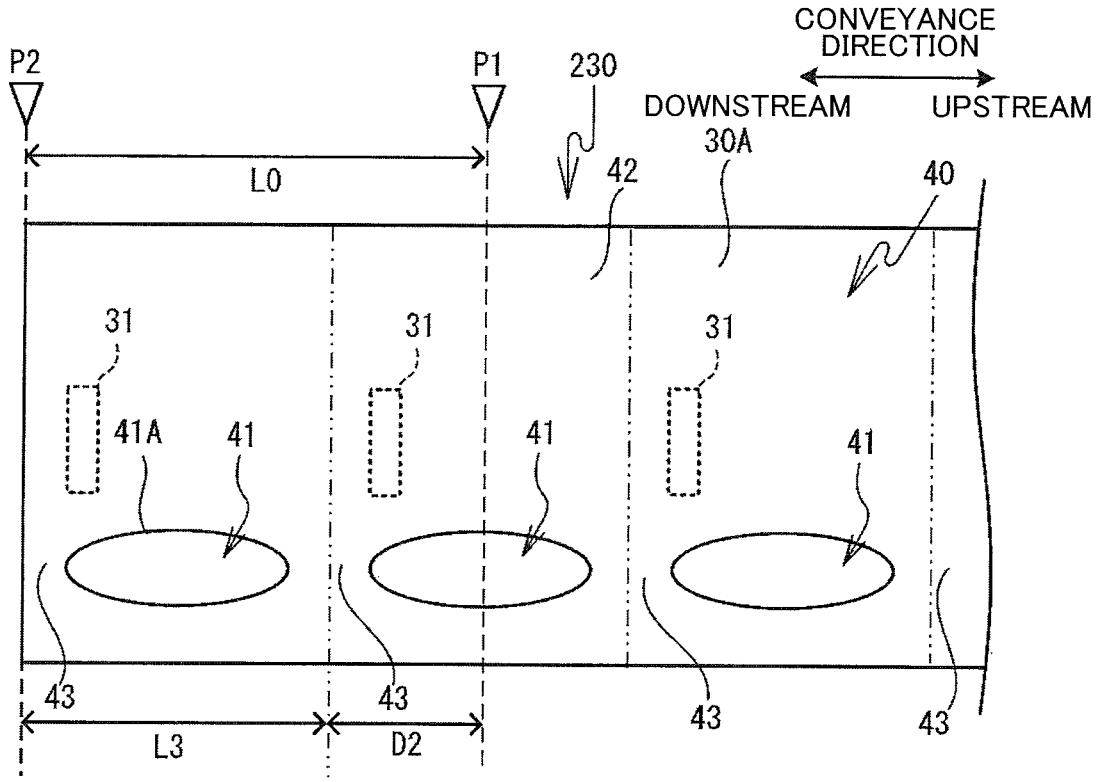
FIGS. 11A and 11B are front views of a tape according to a second modification.
Figure 11B:
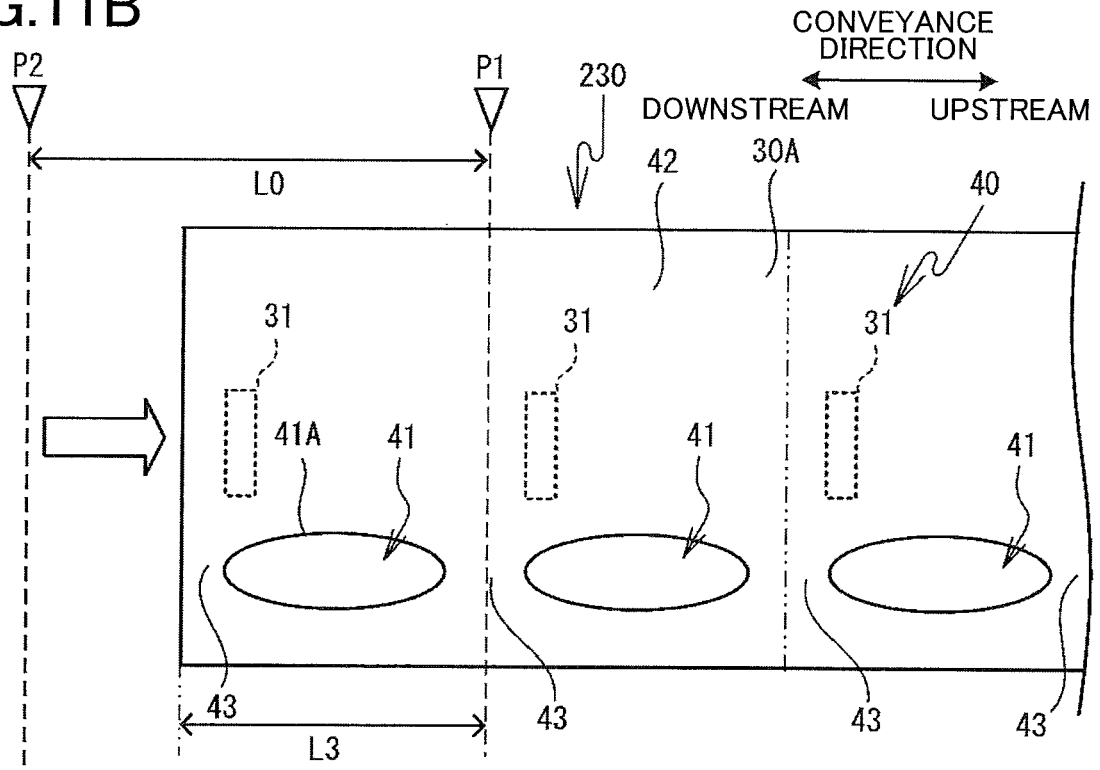
Figure 12:
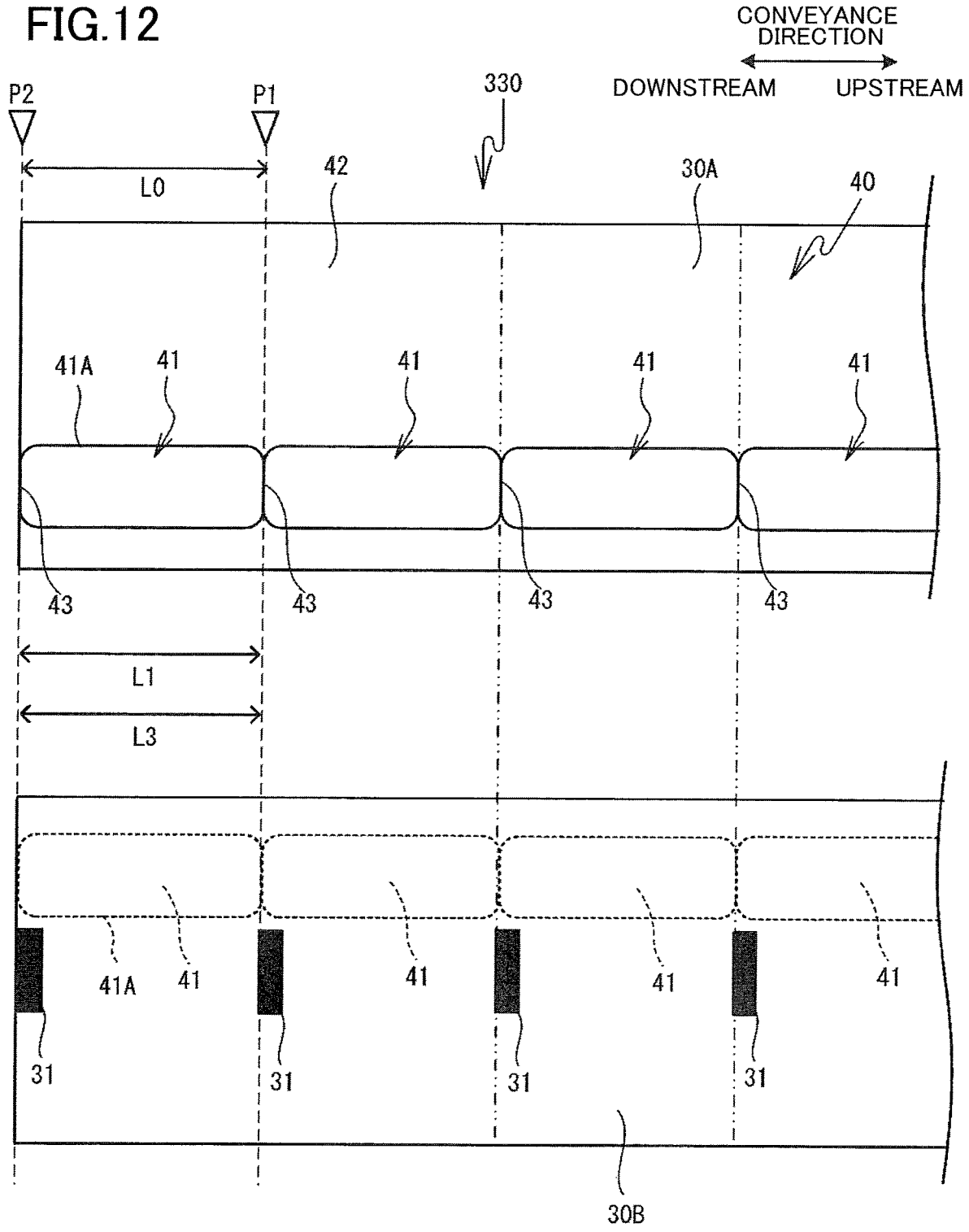
FIG. 12 is a front view and a rear view of a tape according to a third modification.

Referring next to FIGS. 10-12, there will be explained tapes according to modifications. In the printing surface 30A shown in each of FIGS. 10 and 11, the plurality of reference portions 31 provided on the reverse surface 30B are indicated by the dotted line. In the following explanation, the same reference numerals as used for the tape 30 in the illustrated embodiment are used to identify the corresponding components, and main points of difference between the illustrated embodiment and the modifications will be explained. In the illustrated embodiment, there has been explained one example of a control for positioning a leading end of the tape 30 (leading-end positioning control) in an arrangement in which the length L3 and the reference distance L0 are equal to each other. In an arrangement in which the length L3 and the reference distance L0 differ from each other, however, the leading-end positioning control differs from that in the illustrated embodiment.

Figure 10A:
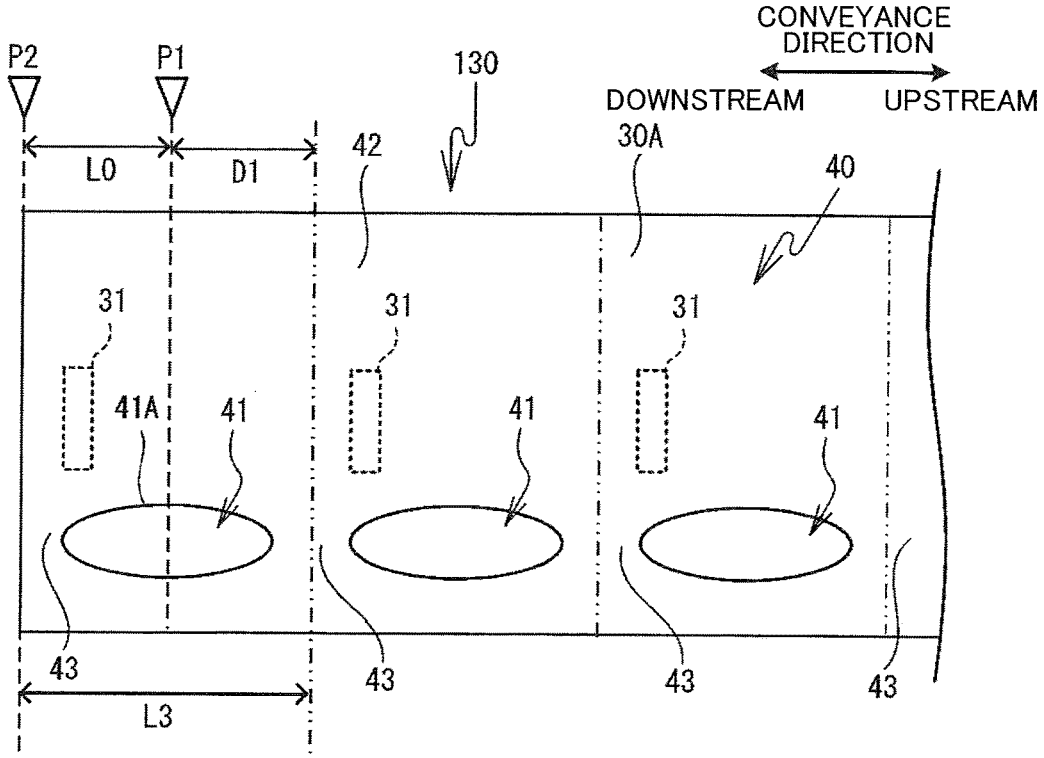
FIGS. 10A and 10B are front views of a tape according to a first modification.
Figure 10B:
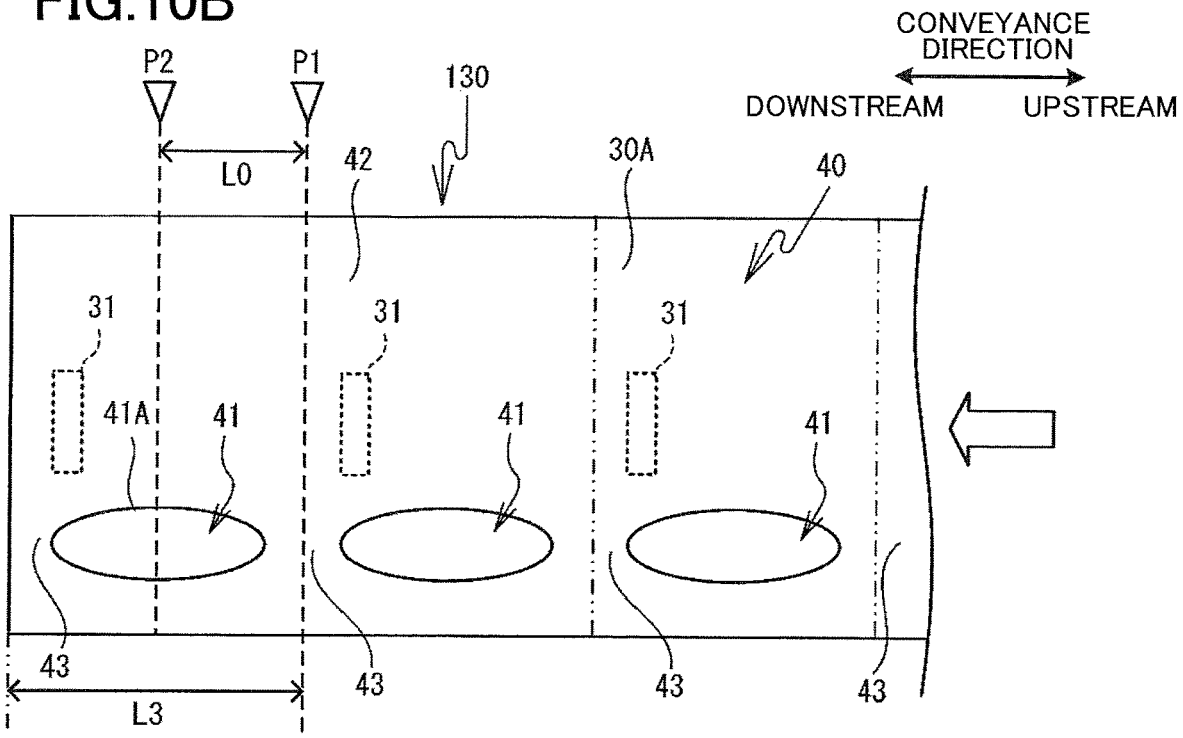

A tape 130 according to a first modification shown in FIG. 10 includes the plurality of first printing regions 41 shaped like an oval whose major axis extends in the conveyance direction. In each first printing region 41, the region marker 41A shaped like an oval and having a red outline and a white inner region is printed in advance. In this first modification, the length L3 is larger than the reference distance L0. A difference between the reference distance L0 and the length L3 is equal to a length D1. As shown in FIG. 10A, the printing apparatus 1 creates a label by fully cutting the tape 130 in the thickness direction (the full cut) at the cutter cutting position P2, and thereafter conveys the tape 130 toward the downstream side in the conveyance direction without winding back the tape 130. Thereafter, the printing apparatus 1 starts printing the label image from a position to which the tape 130 is conveyed by a distance corresponding to the length D1 as shown in FIG. 10B.

When the tape 130 is conveyed from the state shown in FIG. 10A, by the distance corresponding to the length L3, the printing apparatus 1 stops conveying the tape 130 and performs the half cut of the tape 130 at the cutter cutting position P2. Thus, the tape 130 is partly cut in the thickness direction along the width direction at one of the intermediate regions 43 that is located immediately upstream of and adjacent to a top one of the first printing regions 41 in the tape 130. Further, the printing apparatus 1 performs the printing while conveying the tape 130 until the printing of the label image is completed. Thereafter, the tape 130 is stopped being conveyed and is fully cut in the thickness direction at the cutting target region. The head margin corresponding to the distance (length) L3 as measured from the leading end of the tape 130 is demarcated or delimited by the half cut, so that the label image is successively printed without winding back the tape 130 to create a plurality of labels.

A tape 230 according to a second modification shown in FIG. 11 includes the plurality of first printing regions 41 which are similar to but different from the first printing regions 41 of the tape 30 in that the length L3 is smaller than the reference distance L0. A difference between the reference distance L0 and the length L3 is equal to a length D2. As shown in FIG. 11A, the printing apparatus 1 fully cuts the tape 230 in the thickness direction (the full cut) at the cutter cutting position P2 so as to create a label. Thereafter, as shown in FIG. 11B, the tape 230 is wound back, by a distance corresponding to the length D2, toward the upstream side in the conveyance direction by reverse driving of the conveyance motor 214, whereby the tape 230 is positioned with respect to the head printing position P1. The printing apparatus 1 subsequently prints the label image while conveying the tape 230 toward the downstream side in the conveyance direction, then stops conveyance of the tape 230, and finally cuts the tape 230 fully in the thickness direction (the full cut) at the cutting target region. By thus winding back the tape 230 by the distance corresponding to the length D2, the label image is successively printed so as to create a plurality of labels without producing a relatively large head margin in the tape 230.

In the illustrated embodiment, the length L2 of each intermediate region 43 is larger than zero. The length L2 may be substantially zero as described below. A tape 330 according to a third modification shown in FIG. 12 includes the plurality of first printing regions 41 each having a substantially rectangular shape that is elongate in the conveyance direction. The first printing regions 41 are arranged in the conveyance direction with no space interposed between adjacent two of the first printing regions 41. In this arrangement, each of the plurality of intermediate regions 43 corresponds to a boundary line that defines a boundary between corresponding adjacent two of the first printing regions 41 and extends in the width direction of the tape 330. In each of the first printing regions 41, there is printed in advance the region marker 41A shaped like a generally rectangle and having a red outline and a white inner region defined by the outline. In this modification, the length L1 and the length L3 are equal to the reference distance L0. Accordingly, a difference between the reference distance L0 and the lengths L1, L3 is substantially zero. When the tape 330 is cut, the cutter 8 may cut the tape 330 so as to pass the intermediate region 43, as in the illustrated embodiment.

In the label editing process (S13) of the illustrated embodiment, the CPU 201 may receive a cutting-position designating instruction which designates, as a position at which the tape 30 is to be cut, one of candidate regions among the plurality of intermediate regions 43 that is located more upstream than the first end in the conveyance direction. The cutter 8 may cut the tape 30 at the designated candidate region so as to create the label (S17). In this arrangement, when the first end is located more downstream than the second end in the label image, the length in the conveyance direction of the text 81 set for the second printing region 42 exceeds a length in the conveyance direction from the leading end of the tape 30 to the designated candidate region, namely, exceeds the label length. In this case, the CPU 201 may automatically adjust the size of the second characters of the text 81 to be printed such that, in the label image stored in the RAM 204, the text 81 is disposed within the label length. Accordingly, the printing apparatus 1 is capable of creating the label on which the characters are appropriately printed in both the first printing regions 41 and the second printing region 42 with the label length desired by the user.

In the illustrated embodiment and modifications, in the case where the head margin of the tape is demarcated by the half cut, the length of the head margin in the conveyance direction is not limited to the length L3 but may be longer than the length L3. For instance, the head margin of the tape may have a length corresponding to a plurality of units according to a user's instruction, each one unit being constituted by the length L3. As the control for positioning the leading end of the tape, there are illustrated two controls, namely, the control for demarcating the head margin of the tape by the half cut and the control for winging back the tape such that the leading end of the tape returns to the head printing position P1. The user may select one of the controls. In the former control, the tape need not be wound back, thus enhancing the throughput in the printing operation. In the latter control, the head margin of the tape is not substantially produced, enabling an effective use of the tape. Like the control for demarcating the head margin of the tape by the half cut, a control for demarcating the tail margin of the tape by the half cut may be executed.

What is claimed is:

1. A printing apparatus, comprising:

a conveyor configured to convey, in a predetermined conveyance direction, a medium including a printing surface;

a print head configured to perform printing, at a first position, on the medium conveyed by the conveyor;

a cutter configured to cut the medium at a second position located downstream of the first position in the conveyance direction; and a controller configured to control a printing operation based on print data of a label image including at least one first character and second characters, wherein the printing surface includes a plurality of first printing regions arranged parallel to the conveyance direction and a second printing region different from the plurality of first printing regions, wherein the controller is configured to:

perform, as the printing operation, causing the print head to print one of the at least one first character in each of at least one of the plurality of first printing regions and to print the second characters in the second printing region while causing the conveyor to convey the medium, so as to print the label image on the medium and causing the cutter to cut the medium on which the label image is printed, so as to create a label, wherein the medium on which the label image is printed includes:

a first end which is an upstream end of a tail printing region in the conveyance direction, the tail printing region being one of the plurality of first printing regions in which one of the at least one first character is lastly printed; and a second end which is an upstream end of a tail character in the conveyance direction, the tail character being the most upstream one of the second characters in the conveyance direction printed in the second printing region, and wherein the controller is configured to:

cause the cutter to cut the medium at a first cutting target position located upstream of the first end in the conveyance direction in the case where the first end is located more upstream than the second end in the conveyance direction; and cause the cutter to cut the medium at a second cutting target position located upstream of the second end in the conveyance direction in the case where the second end is located more upstream than the first end in the conveyance direction.

2. The printing apparatus according to claim 1, wherein the printing surface includes a plurality of intermediate regions each of which is located between adjacent two of the plurality of first printing regions, wherein the first cutting target position is present in a first intermediate region which is one of the plurality of intermediate regions and which is located upstream of the first end in the conveyance direction, and wherein the second cutting target position is present in a second intermediate region which is one of the plurality of intermediate regions and which is upstream of the second end in the conveyance direction.

3. The printing apparatus according to claim 2, wherein the plurality of intermediate regions include a downstream intermediate region and an upstream intermediate region arranged adjacent to each other with a corresponding one of the plurality of first printing regions interposed therebetween, wherein a distance between an upstream end of the downstream intermediate region in the conveyance direction and an upstream end of the upstream intermediate region in the conveyance direction is a first distance, wherein a distance between the first position and the second position in the conveyance direction is a second distance, wherein the first distance is equal to the second distance, and wherein the controller is configured to cause the cutter to cut, in a period in which the printing operation is being performed, the medium at a top intermediate region that is the most downstream one of the plurality of intermediate regions in the conveyance direction.

4. The printing apparatus according to claim 1, wherein a region marker is indicated in each of the plurality of first printing regions, the region marker being an image indicating a region of the printing surface in which one of the at least one first characters is allowed to be printed.

5. The printing apparatus according to claim 4, wherein the region marker has a color different from colors of the at least one first character and the second characters to be printed by the print head.

6. The printing apparatus according to claim 1, wherein the plurality of first printing regions have mutually the same length in the conveyance direction.

7. The printing apparatus according to claim 6, wherein a size of each of the at least one first character to be printed is smaller than or equal to a size of a corresponding one of the plurality of first printing regions in which said each of the at least one first character is to be printed.

8. The printing apparatus according to claim 2, wherein the controller is configured to:

receive a cutting-position designating instruction which designates, as a position at which the medium is to be cut, one of candidate regions among the plurality of intermediate regions that is located more upstream in the conveyance direction than the first intermediate region, and cause the cutter to cut the medium at the designated one of the candidate regions when the controller receives the cutting-position designating instruction.

9. The printing apparatus according to claim 8, wherein the controller is configured to change, when the controller receives the cutting-position designating instruction, a size of the second characters to be printed such that all of the second characters included in the label image are disposed within the second printing region in accordance with a label length which is a length of the label between a downstream end of the medium in the conveyance direction and the designated one of the candidate regions.

10. The printing apparatus according to claim 1, wherein the controller is configured to cause the print head to print, in a period in which the printing operation is being performed, an image that covers at least one of the plurality of first printing regions in each of which one of the at least one first character is not printed.

11. The printing apparatus according to claim 1, wherein the controller is configured to:

receive a printing-target-region designating instruction which designates, among the plurality of first printing regions, at least one printing target region in each of which one of the at least one first character is to be printed; and cause the print head to print, in a period in which the printing operation is being performed, one of the at least one first character in each of the at least one designated printing target region, when the controller receives the printing-target-region designating instruction.

* * * * *